US005300730A

United States Patent [19]

Ekhaus

[11] Patent Number: 5,300,730

[45] Date of Patent: Apr. 5, 1994

[54] DEVICE FOR CONTROLLING MUSICAL EFFECTS ON A GUITAR

[76] Inventor: Ira B. Ekhaus, 9 Cross St., Belmont, Mass. 02115

[21] Appl. No.: 986,227

[22] Filed: Dec. 7, 1992

[51] Int. Cl.[5] ..... G10D 3/16

[52] U.S. Cl. ..... 84/734; 84/320

[58] Field of Search ..... 84/645, 734, 724, 730, 84/320, 322

[56] References Cited

U.S. PATENT DOCUMENTS 4,228,715 10/1980 Nourney .
4,235,144 11/1980 Lubow et al. .
4,292,875 10/1981 Nourney .
4,503,746 3/1985 Kakehashi .
4,558,623 12/1985 Buchia .
4,630,520 12/1986 Bonanno .
4,653,376 3/1987 Allured et al. .
4,979,423 12/1990 Watanabe .
5,046,394 9/1991 Suzuki et al. .
5,079,536 1/1992 Chapman .
5,123,325 6/1992 Turner .
5,123,326 6/1992 Clevinger .

*Primary Examiner*—William M. Shoop, Jr.
*Assistant Examiner*—Jeffrey W. Donels
*Attorney, Agent, or Firm*—Sprung, Horn, Kramer & Woods

[57] ABSTRACT

A musical device comprises a guitar with a neck and a plurality of strings. A pick-up produces electrical output signals related to the frequency and amplitude of vibration of at least one of the strings. An electronic musical effect generator is receptive of the electronic output signal for altering the frequency and amplitude to produce a musical effect. A strain gauge assembly for plurality of axes is disposed on the guitar neck to sense a plurality of axes of strain in that position during use of the instrument. A pick is actuatable by a user for initiating a note on the guitar. A second sensor senses the manual actuation pressure on the pick and another strain gauge assembly for a plurality of axes is disposed on the pick and generates a plurality of control signals corresponding to structural deflections generated during the use of the pick. A controller is responsive to outputs of the sensors for effecting an alteration in the electronic musical effect generator in response to actuation pressure and strain.

7 Claims, 9 Drawing Sheets

DEVICE FOR CONTROLLING MUSICAL EFFECTS ON A GUITAR

FIELD OF THE INVENTION

The invention relates to the precise, sensitive control of electronic musical effects used in conjunction with electronic musical instruments.

BACKGROUND OF THE INVENTION

Modern electronic instruments produce signals that are passed through a chain of electronic effect generators before being amplified and passed to a speaker system. These electronic effect generators alter the final output sound by modifying properties such as frequency response, overall amplitude, envelope characteristics, echo and sometimes introducing a specific type of distortion.

The prior art provides a musician with control over these properties with knobs, pressure pads, pedals or the selection of pre-defined musical characteristics ("sound patches"). Most musical effect generators alter musical qualities on time scales that span several notes and do not vary within a phrase or note. The relatively clumsy controls associated with these devices have heretofore provided adequate control over musical parameters of these effects at the expense of playing technique.

For example, pedals are used to vary the electronic effects such as distortion, echo or 'wah-wah'. These pedals are operated by a musicians's food and do not provide sensitive control. One device that improves on the standard pedal design is disclosed in U.S. Pat. No. 5,079,536.

Mod wheels are essentially large dials or knobs which generate signals that affect parameters of electronic musical effect generators (i.e., volume or frequency response). Pressure pads measure the pressure applied to a specific point on an instrument, and can be used to control musical parameters. Piezo-electric technology has also been employed to provide touch sensitive characteristics to the keys and is disclosed in U.S. Pat. Nos. 4,558,623 and 4,979,423. While both mod wheels and pressure pads are currently used as parameter controllers (i.e., a MIDI continuous controller) in keyboard instruments, they have a relatively minor impact on playing technique and neither provides the intuitive and sensitive control that is desired. Hence, widespread use of mod wheels and pressure pads on instruments other than keyboards is rare.

The present use of mod wheels and/or pressure pads substantially affects traditional playing technique in guitar-like instruments. For pressure pads, special consideration must be made of the dependency of slight variations in hand placement, while maintaining sensitivity to slight changes in applied pressure. One patent that teaches this approach is U.S. Pat. No. 4,630,520. A patent that employs a strain gauge for parameter control in a guitar-like instrument, is U.S. Pat. No. 4,653,376. However, in this patent the application of strain measurement technology is limited to measurement of string tension.

Another patent U.S. Pat. No. 4,503,746 proposes control of musical parameters in a guitar-like instrument. It employs a Hall effect transducer to measure the force that a musician applies to a shoulder strap. It provides only an indirect linkage between applied force and transducer deflection and its focus is limited to tension measurement in the shoulder strap. Additionally, the tension in the shoulder strap cannot be effectively controlled by the picking hand.

One patent that teaches the use of the guitar pick as a control means is U.S. Pat. No. 4,234,144. It employs a contact switch to determine the exact time that the guitar pick strikes the strings. This control is then used to initiate a predetermined effect as well as increment a strike counter that controls an overall variation of a 'special musical effect' over several notes. As for the case in keyboard based parameter control, no prior art in parameter control for guitar-like instruments provides the intuitive and sensitive control that is desired.

Strain gauges are also employed in guitar-like instruments to translate the vibrations of strings to electrical signals. Patents that teach the use of strain gauge technology to translate acoustic vibrations into electrical signals are U.S. Pat. Nos. 4,228,715 and 4,292,875. Additionally, patents U.S. Pat. Nos. 5,123,325 and 5,123,326 employ piezo film as acoustic/electric transducers, but do not address the issue of parameter control via strain measurement.

One patent that teaches the use of fiber optic technology in parameter control via strain measurement is U.S. Pat. No. 5,046,394. This work measures the deflections of a glove outfitted with fiber optics. In the context of the present invention, this work has several drawbacks:

1. An inconsistent relationship between optical fiber deflection and finger movement,
2. A dependency on hand orientation that severely impacts playing technique, and
3. A lack of tactile feedback that doesn't interfere with playing technique (i.e. a small mechanical resistance proportional to finger deflection).

The present invention provides an intuitive, sensitive device for controlling musical qualities of electronic instruments without affecting the fundamental playing technique of the musician.

SUMMARY OF THE INVENTION

The main object of the present invention is to provide a device for controlling musical effects for the purpose of improved phrasing and control of electronic instruments. This and other objects are achieved in accordance with the present invention by a device strain and pressure transducers installed at several points on both an electronic musical instrument and the accessories used to play said instrument.

In a first embodiment, strain measurement devices are applied to both the neck of an electric guitar and the guitar pick. With slight bends in the guitar neck and/or guitar pick, a musician can generate signals that control electronic musical effects and modify the electric guitar's signal. By measuring a plurality of axes of strain at the guitar pick, an intuitive and sensitive musical configuration is achieved. In this embodiment, analogous to the saxophone mouthpiece or violin bow, the same body part which initiates a note (i.e. fingers), can modulate electronic musical effect parameters that define the final output signal. In contrast to the prior art, the present invention provides strain measurement generated control signals dependent on the structural deflections of guitar-like musical instruments and the accessories associated with said instruments.

DETAILED DESCRIPTION OF THE INVENTION

The detailed embodiments of the invention disclosed herein exemplify the invention and are currently considered to be the most likely embodiments for musical uses. However, many other electronic instruments and their respective accessories can be designed to incorporate strain measurement devices for the purpose of controlling electronic musical effects. Accordingly, the specific embodiments disclosed are only representative of the present invention.

Figure 1:
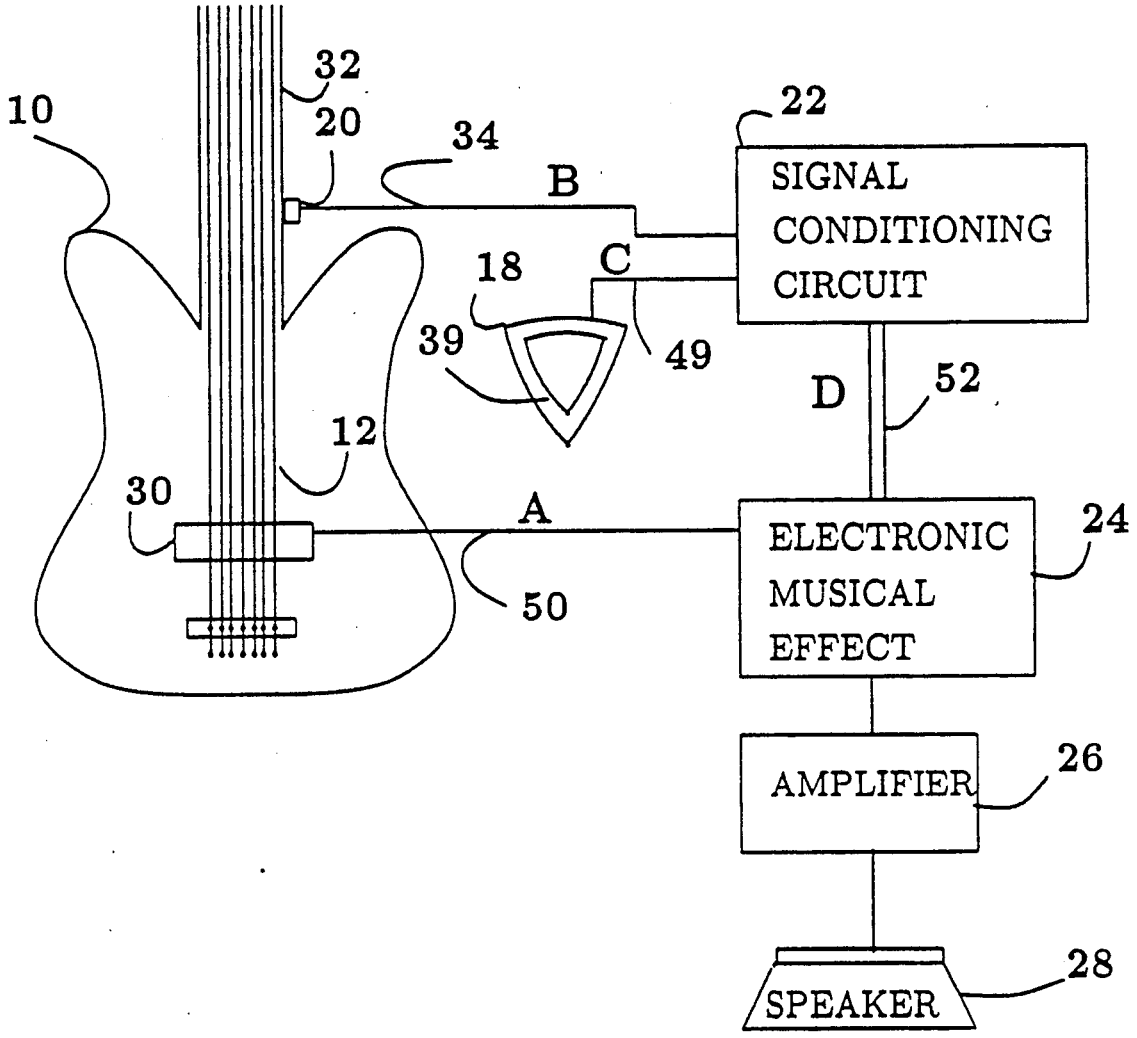
FIG. 1 is a diagrammatic representation of a guitar pick and guitar with the device for controlling electronic musical effects according to the present invention.

FIG. 1 shows a device for controlling the parameters of electronic musical effects in conjunction with the conventional use of an electric guitar 10 and guitar pick 18. A pickup 30 located below the guitar strings 12 provides a signal voltage A on line 50 to an electronic musical effect generator 24. The signal voltage A is related to the magnitude and frequency of the string vibrations. The signal voltage A is passed to the electronic musical effect generator 24, whose output is connected to amplifier 26 which is connected to speaker 28.

Strain measurement devices in accordance with the present invention are installed at various sites along the guitar neck 32 to measure slight bends in the neck in a plurality of axes. A strain gauge assembly 20 on the guitar neck generates a control signal voltage B on line 34 proportional to the flexure in the guitar neck. This control signal voltage B is passed to an input of a signal conditioning circuit 22 for filtering and normalization (see FIG. 5 for details). A separate strain and pressure measurement assembly 39 is installed on the face of a guitar pick 18. Structural deflections in the guitar pick 18 generate another ensemble of control signal voltages C on lines 49 that is passed to another input of the signal conditioning circuit for filtering and normalization. The output D of the signal conditioning circuit 22 is the final ensemble of conditioned signal voltages on line 52 that accurately represents the flexural condition of the guitar and guitar pick. These conditioned control signal voltages are applied on line 52 as an input to the electronic musical effect generator 24.

Figure 2:
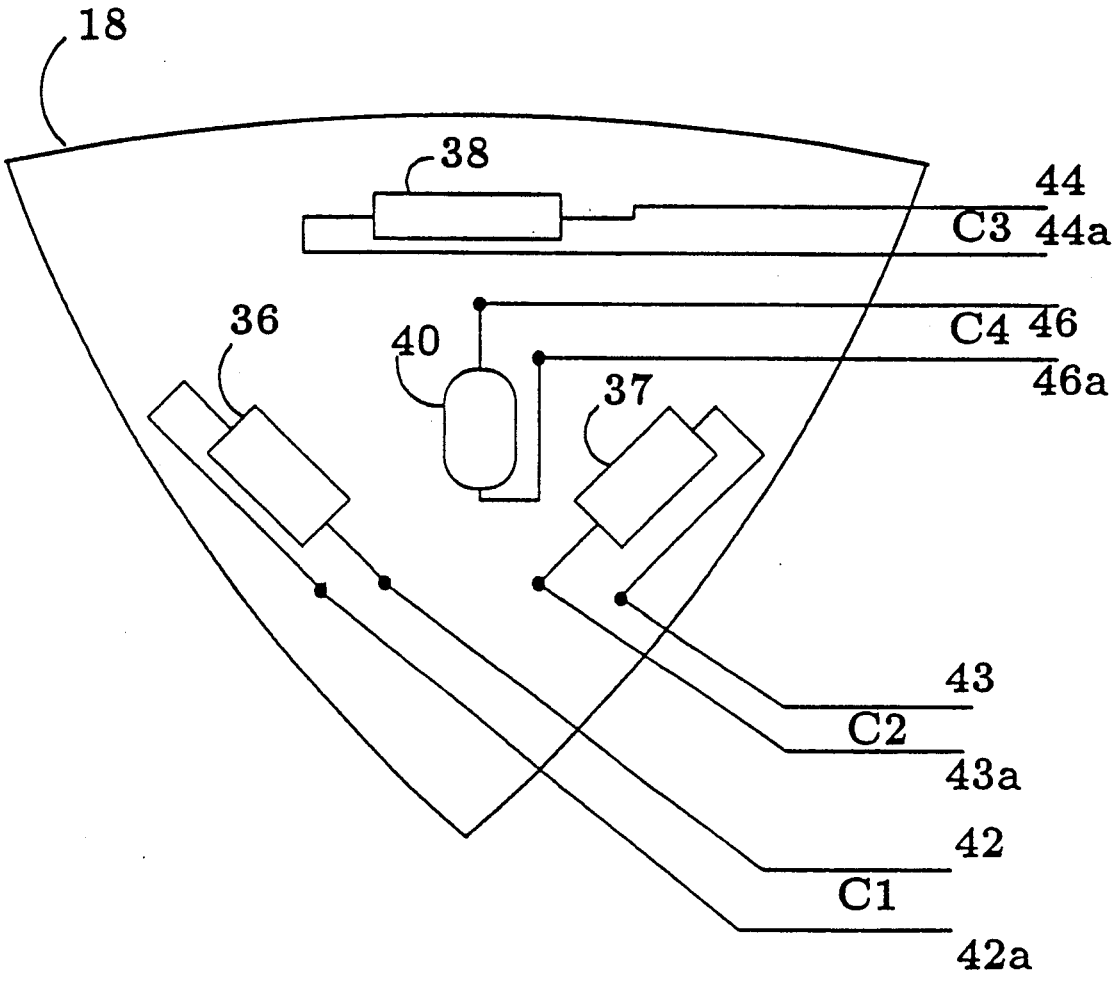
FIG. 2 is a schematic diagram showing the guitar pick of FIG. 1 fitted with pressure gauges and strain gauges.

FIG. 2 shows the details of the strain gauge arrangement installed on the guitar pick 18. In order to measure a plurality of axes, strain gauges 36, 37 and 38 are installed on the guitar pick in a standard rosette configuration. The strain gauges are constructed from a piezoelectric material, a polarized homopolymer of vinylidene fluoride (PVDF). This material is sold under the trademark "KYNAR." Full information about this material can be found in the KYNAR Piezo Film Technical Manual (Attochem Corporation 1987, formerly Pennwalt Corporation). PVDF film has a number of properties that make it advantageous for strain measurement of guitar picks, including the ability to tolerate high strain rates and convenient application. Alternatively, strain gauges with higher sensitivity such as piezo ceramic material (piezo wafers PZT5.RTM., available from Vernitron Piezo Electric, of Bedford, Ohio) or conventional metal foil strain gauges (B.L.H. Canton, Mass.) can also be employed. Under strain, the piezo film generates control signal voltages C1, C2 and C3 on lines 42, 43 and 44 with respect to reference lines **42*a*, 43*a* and 44*a*, that are passed to the signal conditioning circuit 22 and used by the electronic musical effect generator 24. An additional strip of PVDF is configured as a pressure sensor 40 attached to the guitar pick 18 provides a control signal voltage C4 across lines 46–46*a*** proportional to the pressure the pick is held under but independent of guitar pick flexure.

Figure 3:
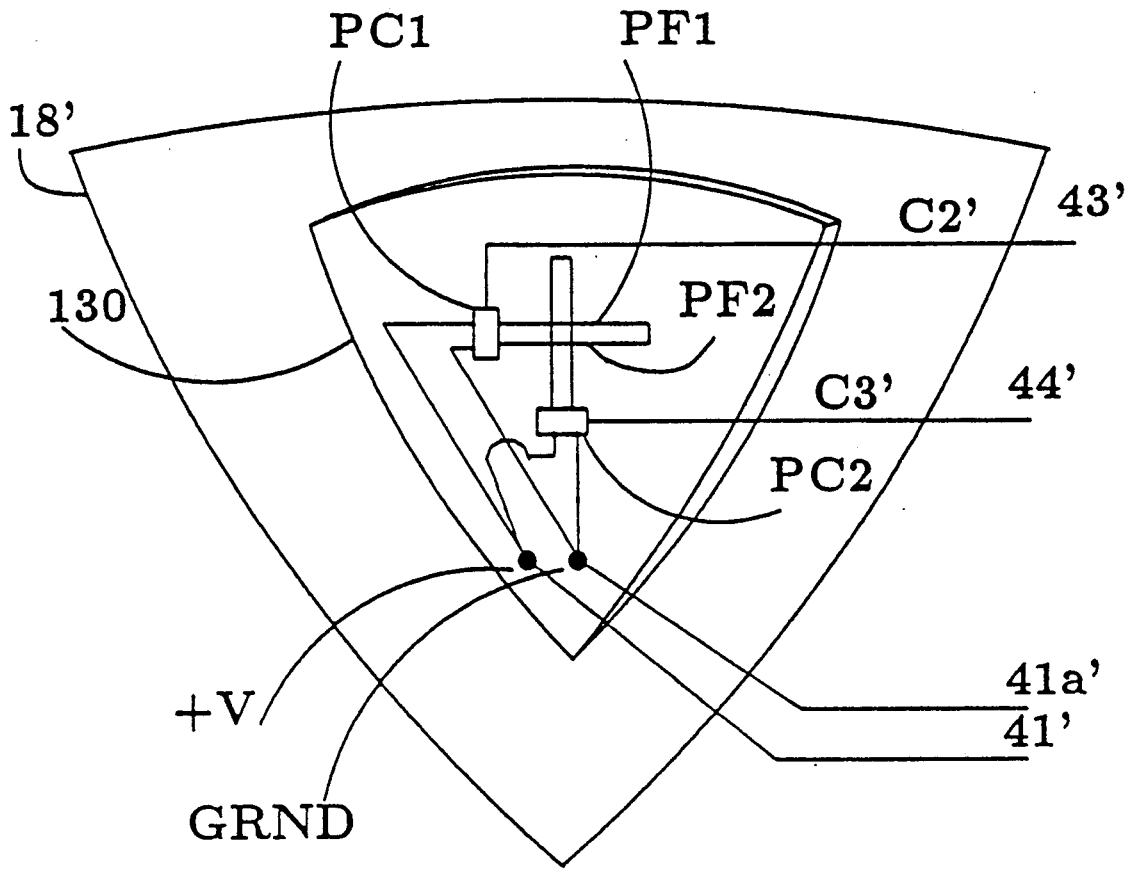
FIG. 3 is a schematic diagram showing an alternative embodiment of the guitar pick of FIG. 1 fitted with optical strain measurement devices.

FIG. 3 shows an alternative embodiment of strain measurement that employs an optical assembly. To measure the horizontal axis, an optical coupling PC1 and optical fiber PF1 are installed along the face of a guitar pick 18' on a resilient mounting layer 130. The vertical axis is similarly measured using another coupling/fiber pair PC2 and PF2. Mounted on the resilient mounting layer 130, both optical fibers PF1 and PF2 experience deflections proportional to guitar pick flexure in their respective axes. A power source +V and ground Grnd are provided through lines 41 and **41*a* respectively. Under strain, control signal voltages C2' and C3' are generated on lines 43' and 44' and passed to the input of the signal conditioning circuit 22 (FIGS. 1 and 4) for subsequent filtering and normalization. For this embodiment, the output D of the signal conditioning circuit 22 is the final ensemble of conditioned signals on line 52 that accurately represents the flexural condition of the guitar and guitar pick. These conditioned control signals are applied on line 52 as an input to the electronic musical effect generator 24**.

Figure 4:
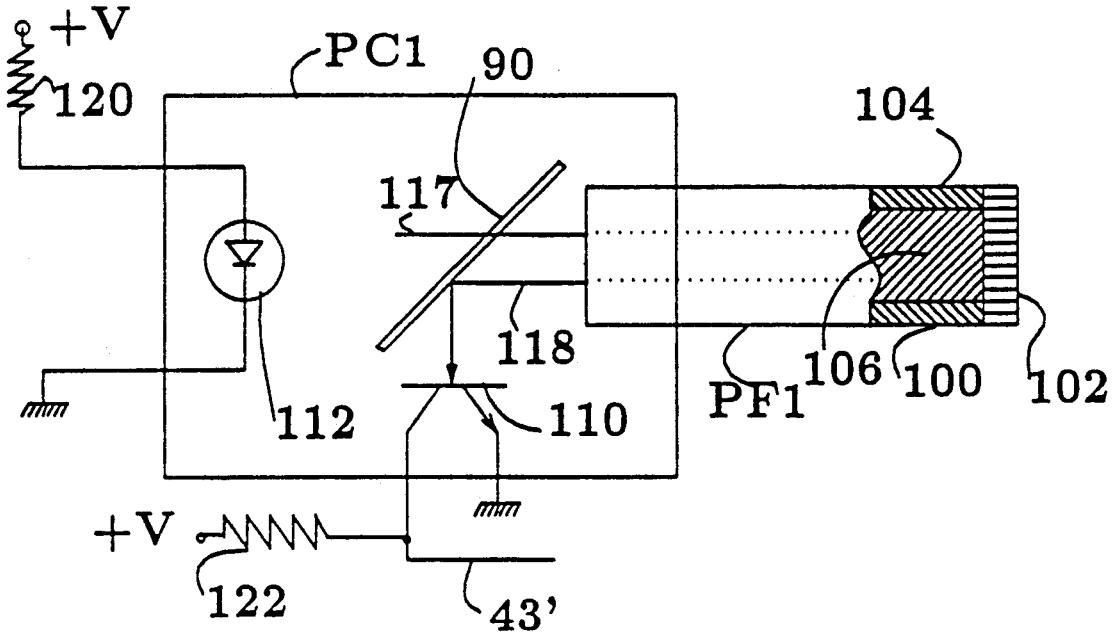
FIG. 4 is a partially broken view of the optical assembly of FIG. 3 comprising an optical fiber and optical coupling.

FIG. 4 shows the details of the optical assembly along with its conditioning circuitry. The optical coupling PC1 is comprised of phototransistor 110, optical mirror 90 and photodiode 112. The optical fiber PF1 is constructed from a core 106 having a fine and long cylindrical shape and whose refractive index is relatively high; a clad 104 having a low refractive index which is provided on the periphery of this core 106 and a coating member 100 which is made from non-optical-transmission and non-optical-absorption materials. The periphery of the clad 104 is coated so that the clad 104 does not leak and absorb the light. At the end of the optical fiber PF1 opposite to the photocoupler PC1, a reflection plate 102 is provided.

The photocoupler PC1, as shown in FIG. 4, consists of a photodiode 112, a half mirror 90 and a phototransistor 110. The anode of the photodiode 112 is connected to a power source +V via a resistor 120, while the cathode thereof is grounded. This photodiode 112 is designed to emit infrared rays 117 therefrom. The half mirror 90 is arranged between the photodiode 112 and the edge portion of the optical fiber PF1, wherein one edge thereof is attached to one edge portion of the optical fiber PF1 which is inclined at 45 degrees. The infrared ray 117 emitted from the photodiode 112 is transmitted through the half mirror 90 and then introduced into the optical fiber PF1. In addition, the half mirror 90 reflects the infrared ray 118 from the optical fiber PF1 so that the reflected infrared ray is introduced to phototransistor 110. The collector of phototransistor 110 is connected to the power source +V via a resistor 122, while the emitter thereof is grounded. In response to the infrared ray 118 received at the base of the phototransistor 110, the phototransistor 110 outputs the corresponding signal on line 43' from its collector. The collector of the phototransistor 110 generates a control signal C2' proportional to the deflection of the optical fiber PF1 which is connected to the signal conditioning circuit 22 shown in FIG. 1.

Figure 5:
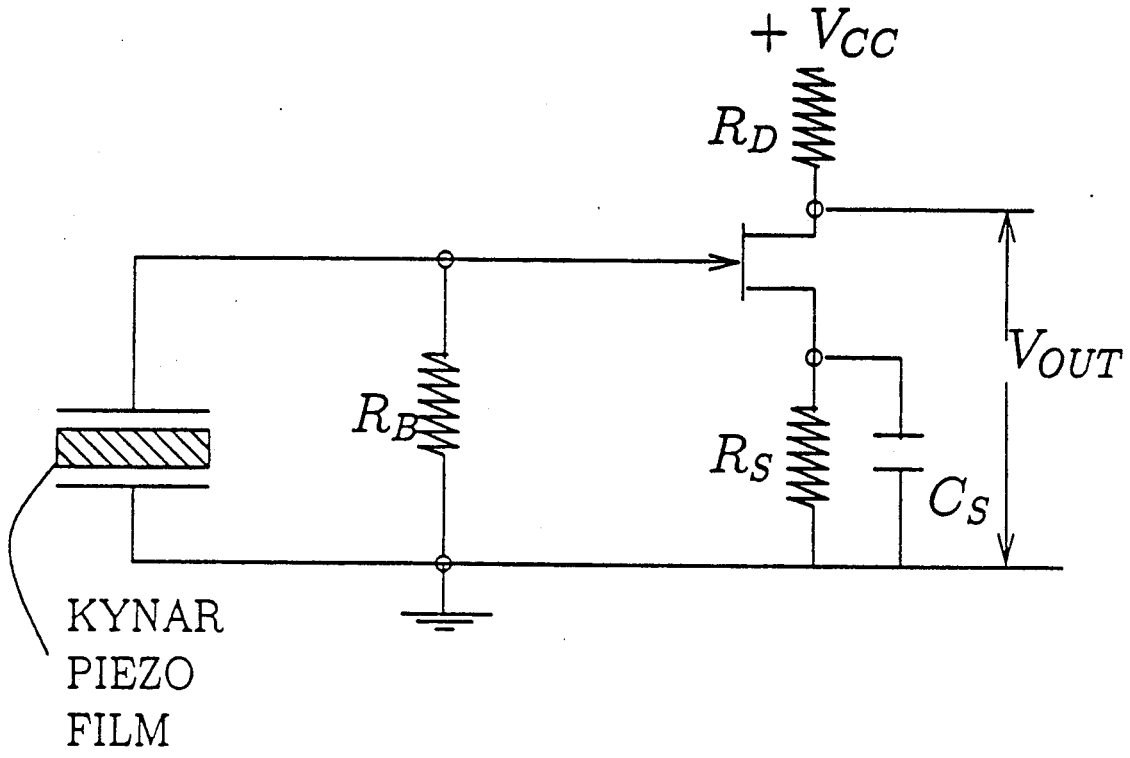
FIG. 5 is a schematic of a signal conditioning circuit designed for use with a piezo film strain gauge.

Signal conditioning circuits, as shown in FIGS. 4 and 5 act as interfaces between transducers and electrical analog circuitry in preparation for readout, further analog transmission or processing, or conversion to digital form. FIG. 5 shows representative embodiments of a low frequency, high gain FET signal conditioning circuit used in conjunction with PVDF film strain gauges. Each PVDF sensor to be measured is connected to a separate copy of this circuit. Design examples for this interface circuit can be found in KYNAR Piezo Film application notes #1 (Attochem Corporation, 1988). The circuit shown acts as a high-pass filter with cutoff frequency $F_{cutoff}=1/(2\pi R_b C_{pf})$ where $R_b$ is the bridge resistance, and $C_{pf}$ is the capacitance of the piezo film of FIG. 5. A voltage source Vcc is applied across drain resistor $R_D$. In order to properly bias the FET, the source voltage is connected to ground through the parallel combination of resistor $R_S$ and capacitor $C_S$. The control signal voltage $V_{out}$ is proportional to voltage across the piezo film which is proportional to the strain the film is held under.

Additionally, a Wheatstone bridge can be used with a standard metal foil strain gauge as a signal conditioner. A signal conditioning module is used to provide excitation to the bridge circuit and also conditions the output of the bridge circuit. One such signal conditioning module is the Analog Devices 2B30 bridge signal-conditioner, the use of which is described in "Transducer Interfacing Handbook" published by Analog Devices, Inc., Norwood Mass.

Figure 6:
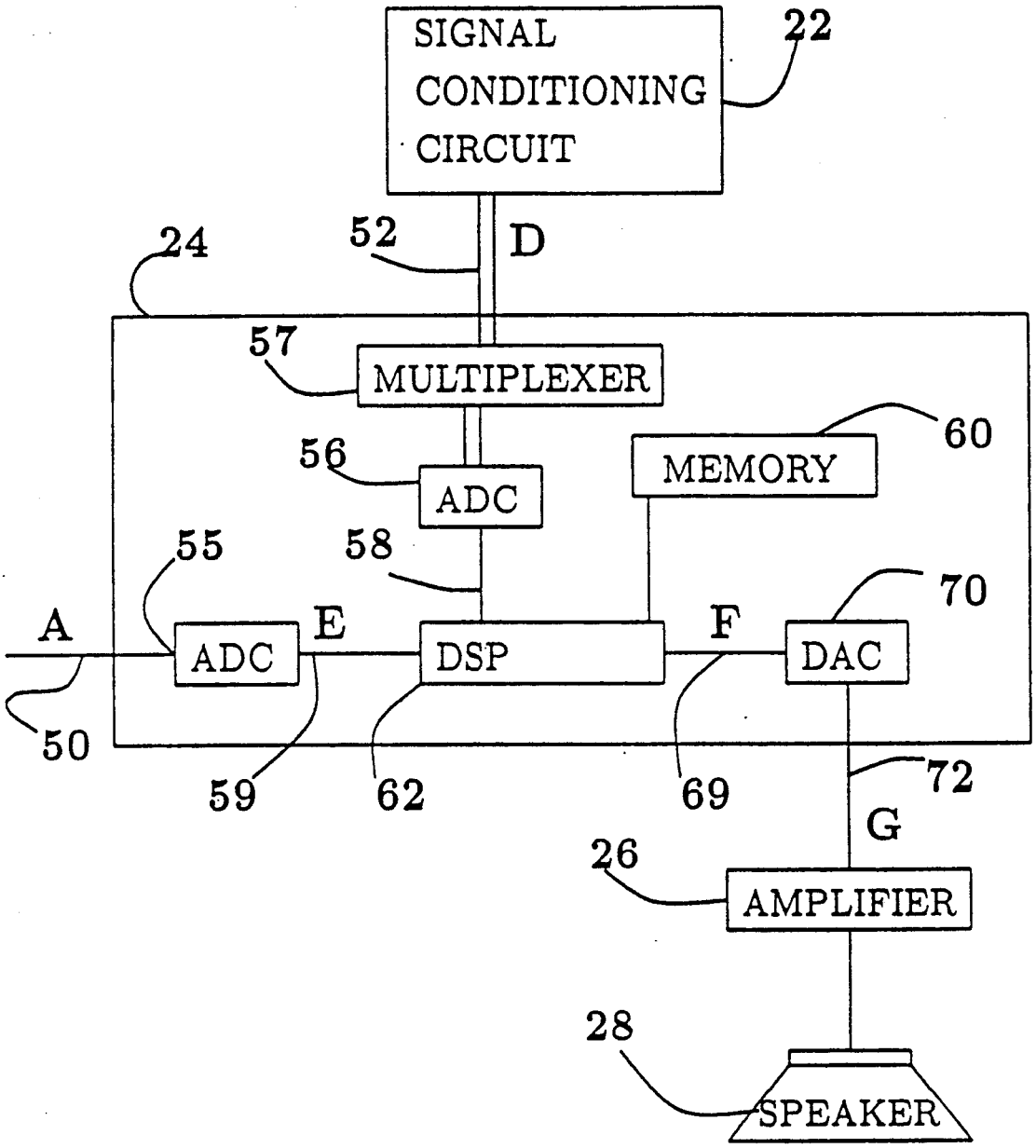
FIG. 6 is a schematic diagram showing the electronic musical effect generator of FIG. 1.

FIG. 6 shows a schematic view of the electronic effect generator 24. This device accepts as input both the guitar output signal voltage A and the ensemble of conditioned control signal voltages Dfrom lines 50 and 52 respectively. The control signal ensemble D is passed through a multiplexer 57 and digitized with an analog-digital converter ADC 56. The digitized signal 58 is applied to and made available to the Digital Signal Processor DSP 62 via a standard digital I/O port. The guitar output signal voltage A is digitized by a separate ADC 55 and the digitized guitar signal E is passed on line 59 to the DSP 62 via a second I/O port. Two chips that are suitable for this application are Motorola's 56K series and Analog Devices' 2110 series. Both are general purpose DSP's that provide a full assembly instruction set for performing arithmetic operations as well the necessary digital I/O.

Both the control signal ensemble D and the signal voltage A are available to the DSP 62 in a digital format for use with whatever algorithm is desired to generate a digital output signal F on line 69. The algorithm implemented by the DSP 62 should be viewed as an arbitrary mapping between a digital input sequence and a digital output sequence; This is a very flexible arrangement. However for the example to follow, a typical effect could be modeled as a discrete time linear system described by an impulse response $h_n$ that is stored in memory 60 and available to the DSP. A separate Digital-to-Analog (DAC) 70 chip converts the digital output of the DSP chip back into an analog signal and filters out any unwanted high frequency components. The final output signal voltage G on line 72 is passed to the amplifier 26 and heard through speaker 28.

The following example of an electronic effect can be utilized in accordance with the invention. When the DSP chip is programmed to implement a linear mapping between the guitar signal output E and algorithm output F it is most readily described by a digital sequence referred to as an impulse response $h_n$. The DSP 62 implements a discrete time convolution of the signal voltage A and the impulse response $h_n$.

Figure 7:
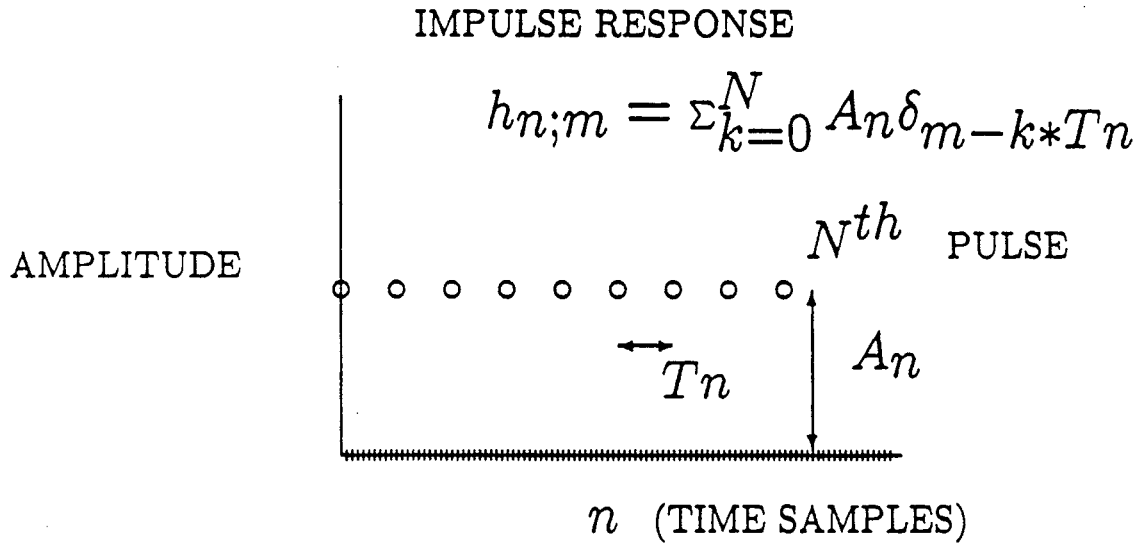
FIGS. 7, 8 and 9 show the mapping operations of the musical effect generator of FIG. 6.
Figure 8:
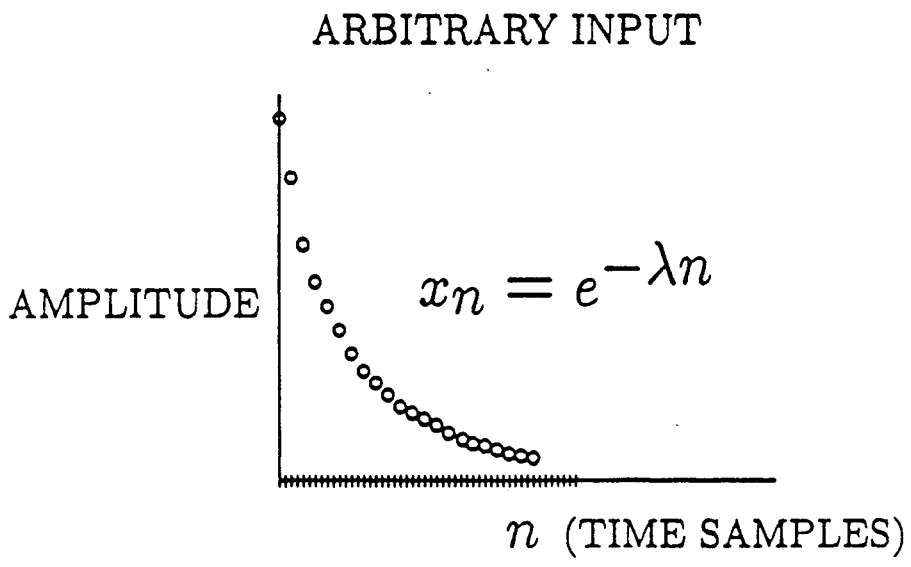
Figure 9:
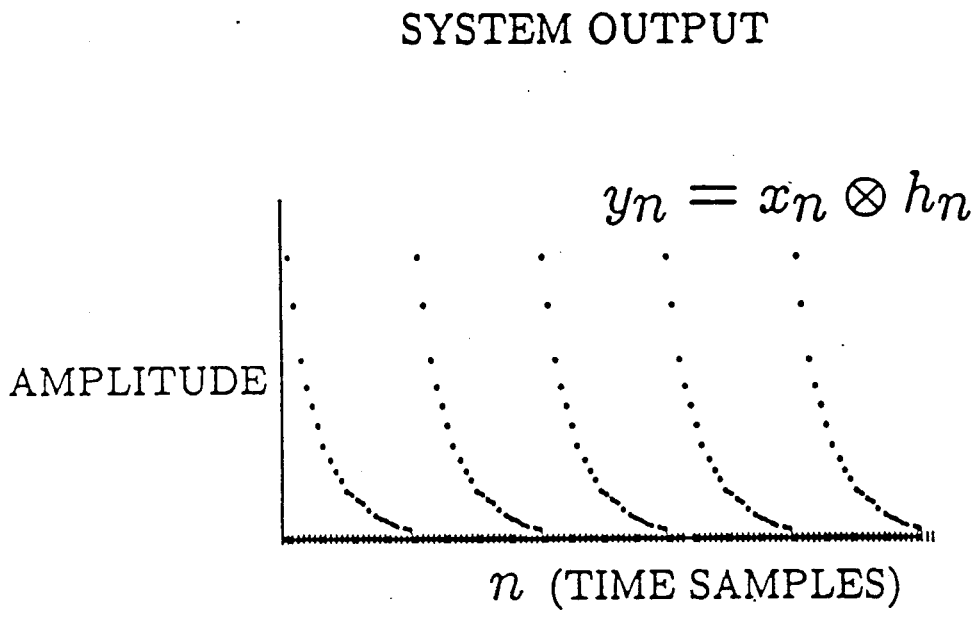

Shown schematically in FIG. 7 is an impulse response $h_n$ parametrically dependent on three parameters: interpulse spacing $T_n$, amplitude $a_n$ and N, the number of pulses in the sequence. The DSP is programmed to define these parameters based on degrees of flexure in the guitar neck 32 and guitar pick 18. Digitized versions of the control signal voltages 58 provide the measurements for these structural deformations. Since these quantities depend on the musician's control and can vary with time, it is more accurate to define a time-varying impulse response impulse response $h_{n;m}$. Within a proper range of parametric values, the sequence $h_{n;m}$ is defined to substantially approximate the repetitive excitation that is characteristic of the mouthpiece of a wind instrument or of a violin bow.

This algorithm, referred to as the "Variable Pulse Train Effect" (VPTE) can be defined by its impulse response $$h_{n;m} = \sum_{k=0}^{N} a_n \delta_{m-kT_n} \tag{1}$$

where n is the discrete time index based on the sampling rate used for digitizing the signal voltage A.

$\delta_n$, the Kronecker delta function of discrete linear system theory is defined as $$\begin{aligned} \delta_n &= 1\ (n=0) \\ &= 0\ (n \neq 0) \end{aligned} \tag{2}$$

$a_n = K_x * X_n$(x-axis control signal) is the time varying amplitude coefficient and $x_n$ is the control signal voltage proportional to the degree of strain in the horizontal of the guitar pick.

$T_n = K_y * Y_n$(y-axis control signal), is the inter-pulse spacing of the impulse response and $y_n$ is the control signal voltage proportional to the degree of strain in the vertical axis of the guitar pick.

$N = K_z * Z_n$, is the number of pulses that comprise the time-varying impulse response $z_n$ is the control signal proportional to guitar neck strain from control signal voltage B.

$K_x$ and $K_y$ $K_z$ are numerical coefficients used for adjusting the system's sensitivity.

The discrete output of this time-varying convolution algorithm is defined as $$y_n = \sum_{m=0}^{\infty} x_m h_{n;m} \tag{3}$$

but since $h_{n;m}$ has finite extent, $$y_n = \sum_{m=0}^{N_{max}} x_m h_{n;m}. \quad (4)$$

Where $N_{max}$ is the maximum number of points needed to account for all values of m for which $x_m h_{n;m}$ is nonzero.

With negligible impact on standard playing techniques, a musician modifies the control signals B, C1, C2, C3, C4 with sufficient ease and precision to incorporate variations of the electronic musical effect into the phrasing of each individual note. By squeezing the guitar pick 18 primarily about a vertical axis, a musician can vary the interpulse spacing $T_n$ of the electronic effects impulse response $h_{n;m}$ and achieve the stridency of a saxophone "wail". While this specific embodiment of an electronic effect (VPTE) is presented because of the clear benefit that is derived by combining the present invention's application of strain gauge technology to DSP algorithms, many other algorithms can be designed to exploit the present invention.

It will be recognized by those skilled in this art that other embodiments and improvements of the invention can be easily realized.

Placement of the signal conditioning circuit 22 in a wristwatch. Transmission of the conditioned control signal ensemble C via radio frequency transmission to a remote unit comprised of a radio frequency receiver, the musical effect generator 24 and associated hardware.

The entire strain and pressure assembly for the guitar pick can be installed in a sheath that the guitar pick fits into. This arrangement allows for the convenient interchange of guitar picks for use with the present invention.

Measurement can be made of any structural deflection of a musical instrument for purpose of varying parameters of musical effects.

The invention provides for the practical use of many electronic effects other than a Variable Pulse Train Effect (VPTE). These effects can be quickly realized by altering the programming of the DSP unit 62.

The benefits of the invention is a sensitive and intuitive control of musical parameters and the allowance for the development of electronic effects that exploit this unique means of control.

What is claimed is:

1. A musical device, comprising:

a guitar with a neck and a plurality of strings;

pick-up means for producing an electrical output signal related to the frequency and amplitude of vibration of at least one of said strings;

electronic musical effect generating means receptive of the electronic output signal for altering the frequency and amplitude thereof to produce a musical effect;

first sensing means comprising a strain gauge assembly disposed on the guitar neck for sensing strain on a plurality of axes on the guitar neck, during use of the guitar;

a pick manually actuatable by a user for initiating a note on the guitar;

second sensing means for sensing manual actuation pressure on said pick;

third sensing means comprising a strain gauge assembly for sensing strain on a plurality of axes on said pick and generating a plurality of control signals corresponding to structural deflections generated during use of said pick;

and control means responsive to outputs of said first, second and third sensing means for effecting an alteration in the electronic musical effect generating means in response to actuation pressure and strain.

2. The device of claim 1, wherein said strain gauge assemblies are comprised of standard foil type strain gauges.

3. The device of claim 1, wherein said strain gauge assemblies are comprised of piezo-film type strain gauges.

4. The device of claim 1, wherein said strain gauge assemblies are comprised of optical fiber type strain gauges.

5. The device of claim 1, wherein said strain gauge assemblies are comprised of a combination of foil, piezo film and optical fiber type strain gauges.

6. The device of claim 1, wherein said electronic musical effect generating means comprises means for storing a discrete time input/output mapping of a sampled version of said electrical signal varying in response to said control signals.

7. The device of claim 1, wherein said control means comprises a MIDI continuous controller.

* * * * *